US005090695A

United States Patent [19]

Ciolino

[11] Patent Number: 5,090,695

[45] Date of Patent: Feb. 25, 1992

[54] EXERCISE FLOAT AND METHOD OF USE

[76] Inventor: Peter A. Ciolino, 561 Cherry Tree La., Kinnelon, N.J. 07405

[21] Appl. No.: 584,377

[22] Filed: Sep. 17, 1990

Related U.S. Application Data

[63] Continuation of Ser. No. 359,215, May 31, 1989, abandoned.

[51] Int. Cl.[5] ..... A63B 23/00

[52] U.S. Cl. ..... 272/144; 272/71; 272/93; 434/254; 5/632; 441/129; D21/237

[58] Field of Search ..... 272/71, 72, 93-96, 272/116, 126-128, 131, 135, 137-139, 144; 441/88, 106, 108, 113, 125, 127-129; 5/417, 419, 420, 431, 470, 481; 434/254; D21/237, 238

[56] References Cited

U.S. PATENT DOCUMENTS

| | | | |
|---|---|---|---|
| D. 272,935 | 3/1984 | Poley et al. | D21/237 X |
| 149,150 | 3/1874 | Peck | 441/128 |
| 228,671 | 6/1880 | Palmer | 441/128 |
| 2,132,544 | 10/1938 | Shaw | 441/127 |
| 2,623,574 | 12/1952 | Damach | 441/129 X |
| 3,093,407 | 6/1963 | Wilson | 5/481 X |
| 3,714,921 | 2/1973 | Gibson | 441/129 X |
| 3,860,976 | 1/1975 | Suyama | D21/237 X |
| 4,394,783 | 7/1983 | Simmons | 441/127 X |
| 4,858,913 | 8/1989 | Stuart | 272/71 |

OTHER PUBLICATIONS

"Marine Life Saving and Water Sport Equipment" by Atlantic-Pacific MFG. Corp., Catalog No. 56, 2-1957, p. 4.

*Primary Examiner*—Richard J. Apley
*Assistant Examiner*—Joe H. Cheng
*Attorney, Agent, or Firm*—Hopgood, Calimafde, Kalil, Blaustein & Judlowe

[57] ABSTRACT

An exercise float platform is formed of specifically dimensioned buoyant sections connected by flexing hinges to permit a user to perform an exercise routine in an aquatic environment. The buoyancy of the individual sections can be selectively adjusted depending on the weight distribution of the individual, or the exercise routine intensity. The exercise float permits the user to perform exercise routines in the water focused on the back, hips and stomach muscle groups along with allowing flexible upper and lower body workouts while either sitting below the water level or reclined above the water level.

11 Claims, 2 Drawing Sheets

EXERCISE FLOAT AND METHOD OF USE

This application is a continuation of application Ser. No. 359,215, filed May 31, 1989 now abandoned.

The present invention generally relates to an apparatus for enhanced aquatic exercising. More particularly, the present invention relates to a flotation device capable of specifically delineated movements in an aquatic environment suitable for a series of exercise routines directed to the back and stomach muscle groups.

BACKGROUND OF THE INVENTION

During the past decade, there has been an explosion of interest in physical activity as both a pastime and a means of acquiring and maintaining good health. Much of the current interest in exercise and other similar activities is based on the recent findings that correlate longevity with active lifestyles. Pursuant to this increased awareness, a corresponding increase in the variety of exercise activities has spawned a plethora of new businesses focused on servicing the needs of this new market.

Many exercise routines are directly focused on the stomach, hips and back as a means for reducing weight and developing a more attractive figure. Almost all structured aerobic exercise routines have a significant portion of their workout concentrated on the stomach, hips and back. These anatomical areas are the first to collect fat in appreciable quantities and therefore engender the most concern from those in pursuit of a slimmer figure.

Conventional forms of exercising the stomach, hip and back muscles include such classic routines as the "sit-up", "leg raises", and "back arches". These routines are often performed over many cycles on a hard surface such a floor, or at best, a pad placed on a floor. These routines cause major stress on back muscles and the vertebrae of the spine, and irritation of the tail bone. Persons suffering from various levels of back problems or similar ailments simply cannot perform more than a handful of sit-ups without increasing levels of pain and discomfort. For the most part, persons with limited capability to do sit-ups are relegated to much less effective forms of exercise.

It has been discovered over the years that water borne exercise involves significantly less stress during a workout while providing the same level or even a greater level of exercise. Aquatic exercising has become a dominate form of physical therapy for persons suffering from bad backs, knee disorders and for the elderly. While the field of aquatic exercise has boomed, it has remained concentrated on only a few forms of exercise and thus limited to certain muscle groups. In particular, aquatic exercise is presently dominated by exercise routines such as swimming, jogging, jumping, and certain arm and leg movements. For the most part, there have been few, if any specific routines directed to the stomach, hips, and back. This void is mostly reflective of the fact that these muscle groups cannot be readily exercised in an aquatic environment.

It was with this understanding of the problems of the prior art that the present invention was developed.

SUMMARY AND OBJECTS OF THE INVENTION

An object of the present invention is to provide a device to enhance aquatic exercise routines performed in a swimming pool or similar environment.

Another object of the present invention is to provide an aquatic exercising device comprised of a multi-part flotation platform having specifically located hinges that act to permit the controlled flexing of the platform pursuant to the specific requirements of the exercise routine being performed.

Yet another object of the present invention is to provide a multi-sectioned flotation platform with sufficient buoyancy to support and hold a user thereof essentially at about the surface of the water while permitting the user to perform exercise routines focused on the stomach, hip and back.

A further object of the present invention is to provide a collapsible multi-sectioned flotation device comprising at least two sections connected by a hinge wherein said hinge permits the user thereof to engage in sit-ups, leg lifts, and back arches while floating in a pool or similar aquatic environment.

Another object of the present invention is to provide a multi-sectioned flotation device where the buoyancy of each float can be changed according to the weight distribution of the user and the type and intensity of the exercise routine desired.

Another object of the present invention is to provide a multi-sectioned flotation device where the user can sit below the water level or recline above the water level allowing upper and lower body aquatic workouts.

The above and other objects of the present invention are realized in a specific illustrative multi-sectioned flotation device wherein at least two sections are connected by a hinge thus permitting the relational pivoting motion of the sections pursuant to specific user flexing movement during an exercise routine performed in an aquatic environment.

The foregoing features of the present invention may be more fully appreciated from the following detailed discussion of a specific illustrative embodiment thereof, presented hereinbelow in conjunction with the accompanying drawings, in which:

FIG. 1 provides a top view of the multi-sectioned flotation platform of the present invention; and FIG. 2 provides a side view of the multi-sectioned flotation platform of the present invention; and FIG. 3 provides a side view of the multi-sectioned flotation platform as used in an exercise routine.

DETAILED DESCRIPTION OF THE INVENTION

Discussing the present invention first in overview, it is a fundamental objective to provide a exercise platform that combines the properties of significant buoyancy with the specific functional requirements associated with exercises focused on or directed to the stomach, hips or back.

Figure 1:
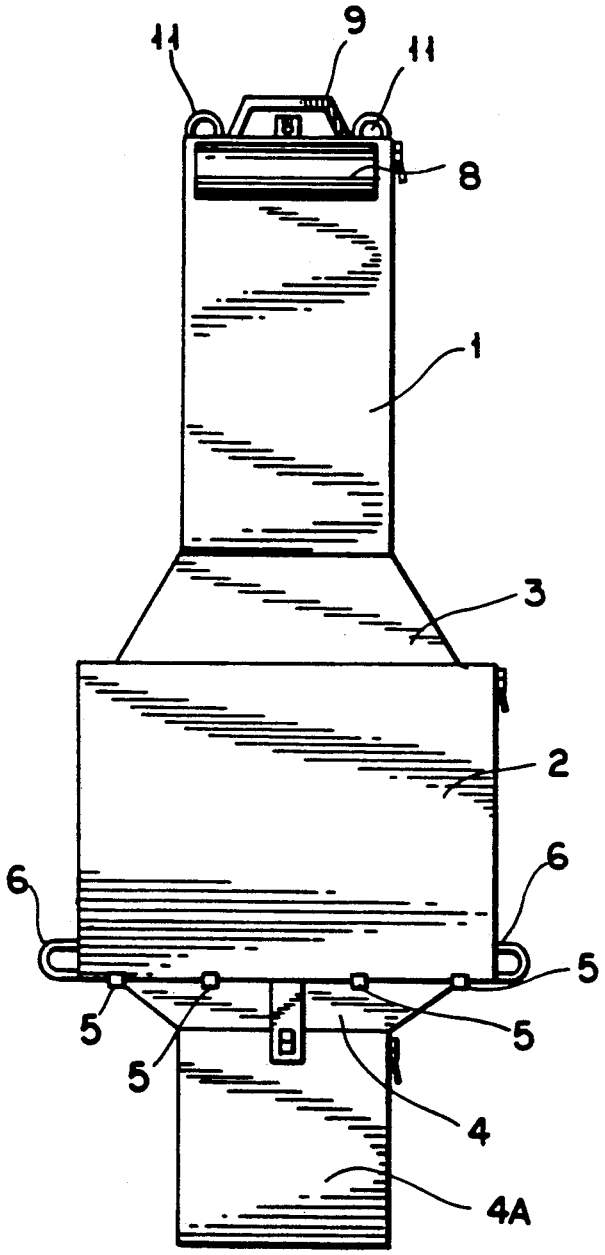
Figure 2:
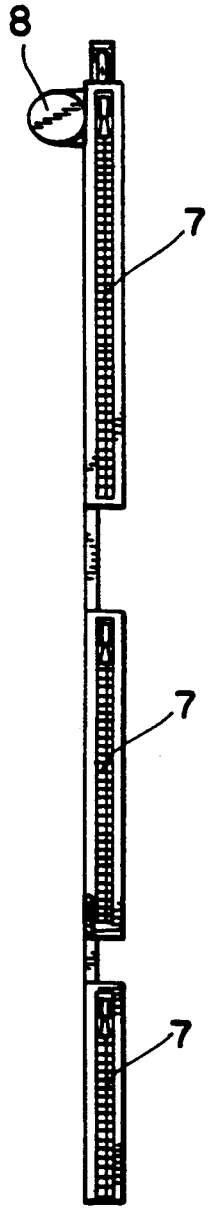

Bearing this in mind and referring to FIGS. 1 and 2, the structure of the flotation platform is presented in top and associated side view. In this particular embodiment, the flotation platform is formed of three discrete float sections. Pursuant to the Figures, an upper float section 1 is connected to a mid float section 2, by vinyl hinge 3. This vinyl hinge 3 separates the upper and lower float section by a distance of approximately 5–6 inches. The use of vinyl for hinge 3 is merely illustrative of suitable hinge material although the use of water resistant material such as vinyl is preferred in view of the aquatic environment for use. The 5–6 inches of spacing between the upper and lower float sections permits the easy flexing of the platform at the hinge location with limited pinching of the user during this flexing. Hinge 3 permits pivoting of the separate sections up to 90 degrees.

The upper float section 1 is dimensioned to correspond to the shape of the back of the individual user and to provide support to the user during the envisioned exercise routines. In this regard, the general shape of the upper float section is long and narrow so that in use it will extend from the user's head or neck to the lower back area (see FIG. 3). The width of the upper float section 1 at the shoulders should be sufficiently narrow so as to not interfere with the free movement of the arms during use. The lower float section 2, is somewhat wider than the upper float section 1 due to the need to support the buttocks and thighs of the user, otherwise referred to herein as the user's seat. The vinyl hinge 3 supports the lower back. Hinge 3 allows the upper and lower float sections to move in similar or different directions depending upon the type of exercise routine performed.

The upper, lower, and foot float sections are all formed of compartmentalized hollow vinyl containers which are capable of receiving buoyant producing materials such as DURAFOAM closed cell flotation cushions. These compartments or pockets are arranged to permit the controlled distribution of the buoyant material to maximize comfort, balance and degree of buoyancy. Access to the compartments is via zipper 7, as shown on each of the separate float sections. As can be seen, the selection of the amount, shape and type of buoyant cushions to pack the various float sections provides the user tremendous flexibility in customizing the exerciser float to the user's particular needs in terms of support and stiffness. The outer shell of the float sections is formed of TEXTRA® or other suitably water resistant material. Alternatively, the aforesaid compartments can also be made of an air tight material and filled with air to create the requisite buoyancy.

Continuing with FIG. 1, a second hinge 4 and foot float 4A is removably attached via snaps to lower float 2. Other forms of fasteners can be substituted such as VELCRO or similar. Two handles 6 are located on lower float 2 for ease of handling and mounting during use in the water. A headrest 8 is provided at the top of upper float 1 for comfort. Handle 9, snap 10 and two straps are provided for foldability and portability of the exercise float.

The material of construction are all soft flexible water resistant materials. If stiffeners are needed for particular routines, these can be appropriately placed into the compartments.

Figure 3:
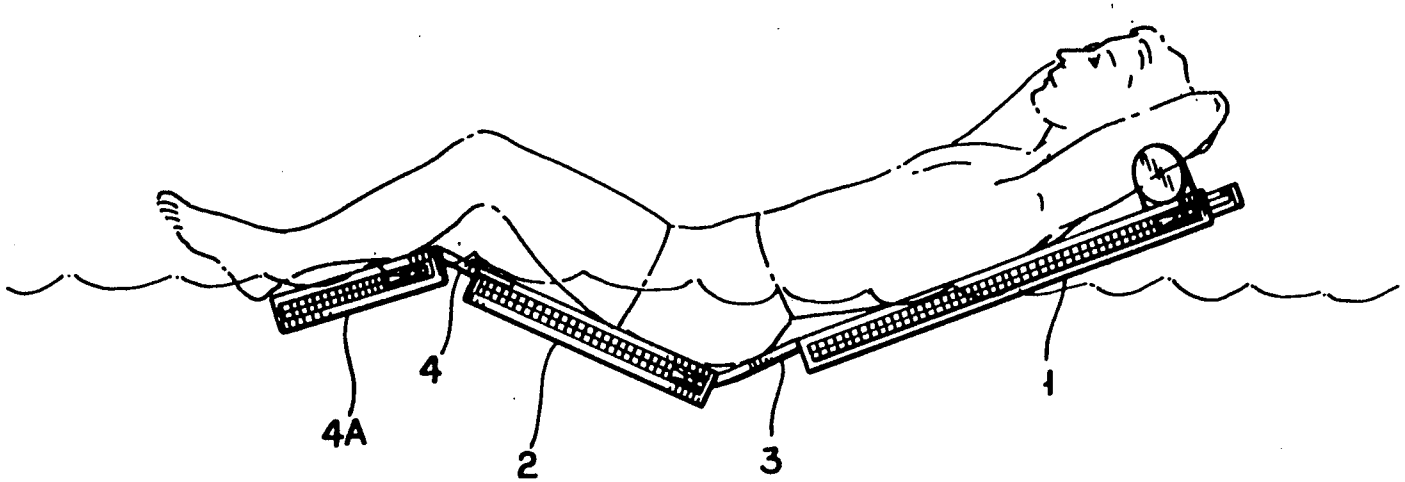

Use of the subject invention is graphically depicted in FIG. 3. When performing abdominal or stomach exercises, the buoyancy of the lower float should be decreased and the buoyancy of the upper float increased. This allows the lower torso to sink easier and faster while performing aquatic sit-ups. To enhance upper body workouts, the buoyancy of the lower float is increased and the buoyancy of the upper float is decreased. This creates greater stability for the exercise float in the sitting position. In the sitting position, the head remains out of the water while the remainder of the body is in the water.

When fully extended, the exercise float acts to support the user in a level position on top of the water, although without the foot float, the lower legs remain submersed in the water. From this position, exercises with both hands and feet can be accomplished.

During a water borne sit-up, the upper float moves in conjunction with the lower float into the water. The lower back and the buttocks are forced into the water so that the user's body is actually in the water at chest level in a sitting position or the user's body is squeezed into a position whereby the knees are forced into the chest. During extension from the sit-up, the user's body will again float to the surface on top of the water. During this and other stomach exercises, the body is supported by the water and the float without strain to the lower back.

In performing more strenuous exercises for the stomach, back and legs, the buoyancy of the lower float can be increased, or the foot float attached to the lower float vis-a-vis the second hinge 4. The foot float maintains the user's feet close to the water level so that the user can touch his toes while doing sit-ups. While sitting or lying in the exercise float, a multitude of other aquatic exercises, as will be generally recognized to those skilled in this art, may be performed.

The exercise float is collapsible to a more compact and transportable form. Snaps and grips are provided to ease overall handling and transport.

The above-described arrangement is merely illustrative of the principles of the present invention. Numerous modifications and adaptations thereof will be readily apparent to those skilled in this art without departing from the spirit and scope of the present invention.

I claim:

1. An apparatus to provide support and buoyancy to a user during an exercise routine performed in an aquatic environment comprising:

a) a long narrow upper floatation section configured to correspond to the shape of the user's back as extending from the upper shoulders to the waist of said user, having a width that is sufficiently narrow thereby permitting the free movement of the arms and shoulders, and having sufficient buoyancy to support the user at submerged surface position in the aquatic environment to perform the exercise routine, b) a wide seat flotation section having a greater width than said upper floatation section and configured to correspond to the shape of the user's seat as made up of the buttocks to the upper thigh region of said user and having sufficient buoyancy to support said seat at said submerged surface position in said aquatic environment, c) a first hinge means located between and operatively connecting said upper flotation section with said seat flotation section in a manner permitting pivoting of said upper and seat flotation sections through an angle of at least 90° between said upper and seat flotation sections, and d) a short narrow lower flotation section configured to correspond to the user's lower legs and feet, having sufficient buoyancy to support said user's lower legs and feet at a submerged surface position in an aquatic environment, and e) a second hinge means located between and operatively connecting said lower flotation section to said seat flotation section in a position so that said upper, seat and lower flotation sections form a substantially elongated float conforming to the total length of the user.

2. The apparatus of claim 1 wherein said upper seat and lower flotation sections are formed of a water resistant material and have at least one inner pocket in each section for holding buoyant producing means.

3. The apparatus of claim 2 wherein said buoyant producing means comprises an air filled closed cell foam cushion.

4. The apparatus of claim 2 wherein said inner pocket is airtight and capable of inflation with a buoyant producing gas.

5. The apparatus of claim 1, wherein the buoyancy of said flotation sections can be adjusted in accordance with a user selected degree of exercise intensity.

6. The apparatus of claim 1, wherein said seat hinge means is removably attached to said upper floatation section.

7. The apparatus of claim 1 wherein said apparatus is collapsible to a form that is easily transported by said user, and further comprises handle means positioned to enhance transport.

8. A method of aquatic exercise performed by a user concentrated on developing and conditioning the muscle groups associated with a user3 s stomach, back and hip areas comprising the steps of:

placing into an aquatic environment a flotation platform of the type characterized by a long narrow upper float section and a wide seat float section joined together by a hinge means, wherein said upper float section is shaped to correspond to the shape of said user's back without interfering with the free movement of said user's arms and shoulders, said seat float section is shaped to correspond to a user's seat, and said hinge means permits pivoting of said upper and seat float sections through an angle of at least 90°.

mounting onto said flotation platform whereby said user is supported at a submerged surface location in the aquatic environment facing upward and said user's back is located proximate to said hinge means permitting movement from both an inclined and upright user position in said aquatic environment during the performance of an aquatic sit up; and exercising in said aquatic environment by user initiated multiple flexures of muscle groups substantially associated with said user's back, hips and stomach.

9. The method of claim 8, wherein said upper and seat sections of said flotation platform can be individually adjusted in terms of buoyancy thereby providing the ability to change type and degree of difficulty of exercise.

10. The method of claim 9, wherein said flotation platform further comprises a short narrow foot float section attached to the seat float section for support of said user's feet during said exercise.

11. The method of claim 10, wherein said flotation platform has handgrips on said seat float section to ease the positioning of said user prior to said exercise.

* * * * *